US011414317B2

(12) United States Patent
Niemela

(10) Patent No.: US 11,414,317 B2
(45) Date of Patent: Aug. 16, 2022

(54) MOVABLE STORAGE SYSTEM

(71) Applicant: NB4 Brand L.L.C., Chassell, MI (US)

(72) Inventor: Marcus Niemela, Scottsdale, AZ (US)

(73) Assignee: The Kingstar Company, Chassell, MI (US)

( * ) Notice: Subject to any disclaimer, the term of this patent is extended or adjusted under 35 U.S.C. 154(b) by 0 days.

(21) Appl. No.: 17/173,758

(22) Filed: Feb. 11, 2021

(65) Prior Publication Data

US 2021/0253418 A1 Aug. 19, 2021

Related U.S. Application Data

(60) Provisional application No. 62/976,652, filed on Feb. 14, 2020.

(51) Int. Cl.
*B68C 1/00* (2006.01)

(52) U.S. Cl.
CPC ..... *B68C 1/002* (2013.01)

(58) Field of Classification Search
CPC ..... B68C 1/002
See application file for complete search history.

(56) References Cited

U.S. PATENT DOCUMENTS

| | | | |
|---|---|---|---|
| 238,243 | A | 3/1881 | Mitchell |
| 3,019,763 | A | 2/1962 | Ferris |
| 3,387,825 | A | 6/1968 | Kreeger |
| 3,574,388 | A | 4/1971 | Stone |
| 3,726,256 | A | 4/1973 | Bernhardt et al. |
| 3,741,529 | A | 6/1973 | Blagg |
| 3,828,733 | A | 8/1974 | Correia |
| 3,943,890 | A | 3/1976 | Calia |
| 3,970,045 | A | 7/1976 | Graham, Jr. |
| 4,052,098 | A | 10/1977 | Metz |
| 4,090,472 | A | 5/1978 | York |
| 4,153,011 | A | 5/1979 | Weissman et al. |
| 4,168,933 | A | 9/1979 | Kane |
| 4,250,836 | A | 2/1981 | Smith |
| 4,355,594 | A | 10/1982 | Wagner |

(Continued)

FOREIGN PATENT DOCUMENTS

DE 202014010012 U1 * 4/2016 ..... B60P 3/04

OTHER PUBLICATIONS

Brochure entitled "TNC Travel N Corrals, Lightweight Portable Corrals", published on or before Jul. 6, 2016.

*Primary Examiner* — Jessica B Wong
(74) *Attorney, Agent, or Firm* — Gardner, Linn, Burkhart & Ondersma LLP

(57) ABSTRACT

A movable storage system provides a repositionable storage location for livestock tack, including saddles and blankets. The system is particularly well suited for horse trailers and other types of transport trailers. The system includes a pivotably movable upright panel or wall that is fitted with horizontal storage arms or shelves for supporting various equipment and tack. The system can be repositioned at different angular positions relative to the upright stationary walls of the trailer, as desired. The system includes hinges coupling one side of the storage system to the trailer to provide a vertical pivot axis about which the system is pivotable. Latches are provided to secure the system at a desired angular position within the trailer. Storage compartments and gates may be included with the storage system.

20 Claims, 10 Drawing Sheets

(56) References Cited

U.S. PATENT DOCUMENTS

| | | | | |
|---|---|---|---|---|
| 4,468,046 | A | 8/1984 | Rutherford | |
| 4,494,733 | A | 1/1985 | Olsson | |
| 4,537,151 | A | 8/1985 | Bolton | |
| 4,659,136 | A | 4/1987 | Martin et al. | |
| 4,733,899 | A | 3/1988 | Keys | |
| 4,958,594 | A | 9/1990 | Swagerty | |
| 4,964,768 | A | 10/1990 | Shomo | |
| RE33,959 | E | 6/1992 | Mollhagen | |
| 5,235,468 | A | 8/1993 | Stephens | |
| 5,240,301 | A | 8/1993 | Arnold | |
| 5,303,947 | A | 4/1994 | Gerber | |
| 5,361,929 | A | 11/1994 | McLain et al. | |
| 5,427,486 | A | 6/1995 | Green | |
| 5,490,705 | A | 2/1996 | Barr | |
| 5,513,595 | A | 5/1996 | Chatterton | |
| 5,688,087 | A | 11/1997 | Stapleton et al. | |
| 5,715,641 | A | 2/1998 | Hall, Jr. | |
| 5,738,037 | A | 4/1998 | Mahan | |
| 5,738,341 | A | 4/1998 | Lease | |
| 5,810,412 | A | 9/1998 | Hall | |
| 5,887,928 | A | 3/1999 | Fenske | |
| 5,924,385 | A | 7/1999 | Cossel | |
| 6,067,940 | A | 5/2000 | Holder | |
| 6,077,007 | A | 6/2000 | Porter et al. | |
| 6,206,624 | B1 | 3/2001 | Brandenburg | |
| 6,257,558 | B1 | 7/2001 | Levine et al. | |
| 6,283,537 | B1 | 9/2001 | DeVore, III | |
| 6,467,433 | B1 | 10/2002 | Stanton et al. | |
| 6,477,985 | B1 | 11/2002 | Mennenga et al. | |
| 6,499,435 | B2 | 12/2002 | Markham | |
| 6,557,329 | B2 | 5/2003 | Schmidt | |
| 6,571,744 | B1 | 6/2003 | Olson et al. | |
| 6,595,496 | B1 | 7/2003 | Langlie et al. | |
| 6,622,436 | B1 | 9/2003 | Kretsch | |
| 6,662,751 | B1 | 12/2003 | Rutter | |
| 6,755,155 | B2 | 6/2004 | May | |
| 6,863,029 | B1 | 3/2005 | Neufelder | |
| 6,866,252 | B2 | 3/2005 | Pulliam | |
| 6,895,897 | B1 | 5/2005 | Culp et al. | |
| 7,004,525 | B1 | 2/2006 | Turnbow | |
| 7,040,253 | B1 * | 5/2006 | Clark | B60P 3/04 49/411 |
| 7,325,513 | B1 | 2/2008 | Velasquez | |
| 7,350,480 | B1 | 4/2008 | Hughes | |
| 7,393,042 | B2 | 7/2008 | Alfstad-Seibel et al. | |
| 7,500,573 | B1 * | 3/2009 | Flynn | B68B 9/00 211/85.11 |
| 7,628,436 | B1 * | 12/2009 | Cutler | B60P 3/04 119/412 |
| 7,637,060 | B2 | 12/2009 | Starheim et al. | |
| 7,669,809 | B1 * | 3/2010 | Toner | B68C 1/002 248/150 |
| 7,685,970 | B1 | 3/2010 | Rains | |
| 7,874,436 | B2 * | 1/2011 | Hought | A47B 81/00 211/1.51 |
| 7,918,465 | B2 * | 4/2011 | Metzger | B60P 1/027 280/439 |
| 7,942,277 | B1 * | 5/2011 | Flynn | B68C 1/002 211/1.53 |
| 8,171,889 | B2 | 5/2012 | Lindfors et al. | |
| 8,281,696 | B2 | 10/2012 | Schmidlkofer | |
| 8,281,969 | B2 | 10/2012 | Schmidlkofer | |
| 8,322,580 | B1 | 12/2012 | Hamilton | |
| 8,322,966 | B2 | 12/2012 | Doskocil | |
| 8,529,184 | B1 * | 9/2013 | Hanser | B68C 1/002 414/743 |
| 8,616,383 | B1 * | 12/2013 | Miller | B68C 1/002 211/1.51 |
| 8,870,243 | B2 | 10/2014 | Elkington et al. | |
| 9,132,762 | B1 | 9/2015 | Heath | |
| 10,206,369 | B2 | 2/2019 | Niemela et al. | |
| 10,405,516 | B2 | 9/2019 | Niemela et al. | |
| 2003/0209206 | A1 | 11/2003 | Campbell | |
| 2003/0209208 | A1 | 11/2003 | Campbell et al. | |
| 2007/0187345 | A1 * | 8/2007 | Hought | A47B 81/00 211/85.11 |
| 2017/0215373 | A1 | 8/2017 | Ruetenik | |
| 2017/0341923 | A1 * | 11/2017 | DeWitt | B60P 7/0815 |

* cited by examiner

MOVABLE STORAGE SYSTEM

CROSS REFERENCE TO RELATED APPLICATION

The present application claims priority of U.S. provisional application Ser. No. 62/976,652 filed Feb. 14, 2020, which is hereby incorporated herein by reference in its entirety.

FIELD OF THE INVENTION

The present invention relates to a movable storage system for transport trailers, and in particular to a movable equipment storage wall.

BACKGROUND OF THE INVENTION

Those who move livestock, goods, or materials over-the-road from one location to another, for reason of work, hobby or show, typically do so using towable trailers especially designed for this purpose. For purposes of discussion, horses as a form of livestock will be referenced throughout the present application because they are a common livestock animal that is carried in over-the-road trailers, such as behind pickup trucks, vans, and other towing vehicles, but it will be appreciated that livestock and equipment associated therewith are intended to represent substantially any equipment that is stored in a trailer or in proximity to the location of intended use of that equipment.

Typical horse trailers have provisions to accommodate one or more horses in a main compartment, as well as saddles, bridles, blankets and other horse-related equipment known generally as "tack". After transport, users often unload equipment and livestock from the trailer for use thereof. Saddles, while well suited for fitment on the back of a horse, are not particularly well suited for space-efficient storage.

SUMMARY OF THE INVENTION

The present invention provides a movable storage system for the provision of storage locations for various types of equipment within a transport trailer, such as a livestock transport trailer. The storage system includes a vertical panel or wall that is pivotable about one of its sides and a plurality of storage arms that are fixed to one face of the vertical panel. The storage arms extend horizontally away from the panel and each define a storage location for equipment, such as saddles, blankets, leads, bridles, headstalls and other livestock related tack. The vertical panel is pivotably repositionable at various angular positions to provide selective access to the storage system and different portions of the trailer. It will be understood that references to horses or other livestock herein are for purposes of providing examples of applications and features of the disclosed embodiments, and are not intended to limit the invention to livestock transport and containment applications. In addition, while the various embodiments are described with reference to a towable livestock trailer, it will be appreciated that the principles of the present invention may be adapted to campers and camper trailers, equipment and supply storage trailers, cargo vans, trucks, and self-powered recreational vehicles, and even to stationary structures such as barns, sheds, and homes where similar equipment storage is desired, without departing from the spirit and scope of the present invention.

In one form of the present invention, a movable storage system is provided for storing equipment, such as saddles, blankets, and other livestock tack in a transport trailer. The storage system includes vertical moveable upright panel or wall that is pivotably mounted within the interior of the transport trailer for storing the various equipment. Horizontal storage arms are disposed on one face of the movable panel, such as the rear face of the panel when viewing the trailer from the rear end. The movable panel is pivotable about a vertical axis at one side of the movable panel such that the panel may be positioned at one of the desired angular positions. The desired angular positions may include a transport configuration for use when transporting the trailer, a tacking configuration for use when "tacking up" an animal, and an access configuration to provide access to an interior of the trailer.

In one aspect, the movable storage system includes an upper pivot element and a lower pivot element disposed on one side of the vertical panel and pivotably coupled to a portion of the trailer. The pivot elements define a vertical pivot axis of the storage system. Optionally, the upper pivot lower pivot elements are barrel hinges disposed between the side of the panel and a vertical support that is disposed vertically between the ceiling and the floor of the transport trailer. The vertical support may define a portion of a livestock living quarter or corral stall disposed in the trailer.

In another aspect, each of the storage arms extends horizontally away from the vertical panel to define horizontal shelves for storing equipment. The horizontal shelves may be configured to support a saddle in an upright orientation. Optionally, a compartment is disposed along a face of the vertical panel and the compartment defines a storage space for large, narrow, and flat equipment, such as wheel covers. The compartment may be sized and shaped to receive and secure a wheel cover that covers a wheel section of the exterior of the trailer while the trailer is not in transport. The wheel cover may include a support bracket to couple the wheel cover to an exterior of the trailer, such as at a sidewall of the trailer above the wheel section.

In yet another aspect, an equipment hanger bracket is coupled to the vertical panel to support equipment such as bridles, headstalls, extension cords, rope, and the like. The equipment hanger has a hollow elongate main hanger body and an equipment support finger coupled to a portion of the main hanger body. The main hanger body may include a U-shaped cutout and a portion of the main hanger body extending into the center of the U-shaped cutout may form the equipment support finger.

In still another aspect, the movable storage system includes a spring loaded pin coupled to a side of the vertical panel opposite the vertical pivot axis. The spring loaded pin engages one of the pin receivers that are spaced along the interior of the transport trailer. The pin receivers are located to set the movable panel's angular positions and each provides a latching point for securing the movable panel at one of the desired angular positions.

In another form of the present invention, a transport trailer includes a moveable tack wall for storing equipment inside the trailer, such as storing saddles, blankets, and other livestock tack. The trailer includes stationary upright walls, a floor, a roof/ceiling, and a set of wheels. The trailer includes a pivotable upright wall or moveable tack wall in the interior of the trailer. The tack wall is moveable between a various angular positions relative to the stationary upright walls. The tack wall includes saddle racks extending from a face of the tack wall and equipment support bars also extending from the face of the tack wall. The saddle racks may be positioned on the tack wall in an alternating spaced arrangement with the support bars.

In one aspect, the tack wall of the transport trailer includes a compartment that defines a storage space for large, narrow, and flat equipment. The compartment is shaped and sized to receive and secure a wheel cover that is configured to cover one of the pair of wheels at the exterior of the trailer while the trailer is not in transport. The wheel cover includes a support for coupling the wheel cover to an exterior of one of the stationary upright walls of the trailer.

In another aspect, the transport trailer includes a removable gate that is deployable to form a barrier along an opening defined between the tack wall and the stationary upright walls.

Thus, the movable storage system of the present invention provides a repositionable storage location for livestock tack, including saddles and blankets, as well as for other equipment. While the system is particularly well suited for horse trailers, the system is also contemplated for use inside and outside of other types of transport trailers, other types of vehicles, or stationary structures. The system can be repositioned at different angular positions that define various configurations include a transport configuration, a tacking configuration, and an access configuration. The system includes hinges coupling one side of the storage system to the trailer to provide a vertical pivot axis about which the system is pivotable. The system includes horizontal storage arms or shelves that are configured to support the equipment to be stored thereon. Latches are used to secure the system at a desired angular position within the trailer. The system may include additional features such as storage compartments and barrier gates.

These and other objects, advantages, purposes, and features of the present invention will become more apparent upon review of the following specification in conjunction with the drawings.

DETAILED DESCRIPTION OF THE PREFERRED EMBODIMENTS

Figure 1:
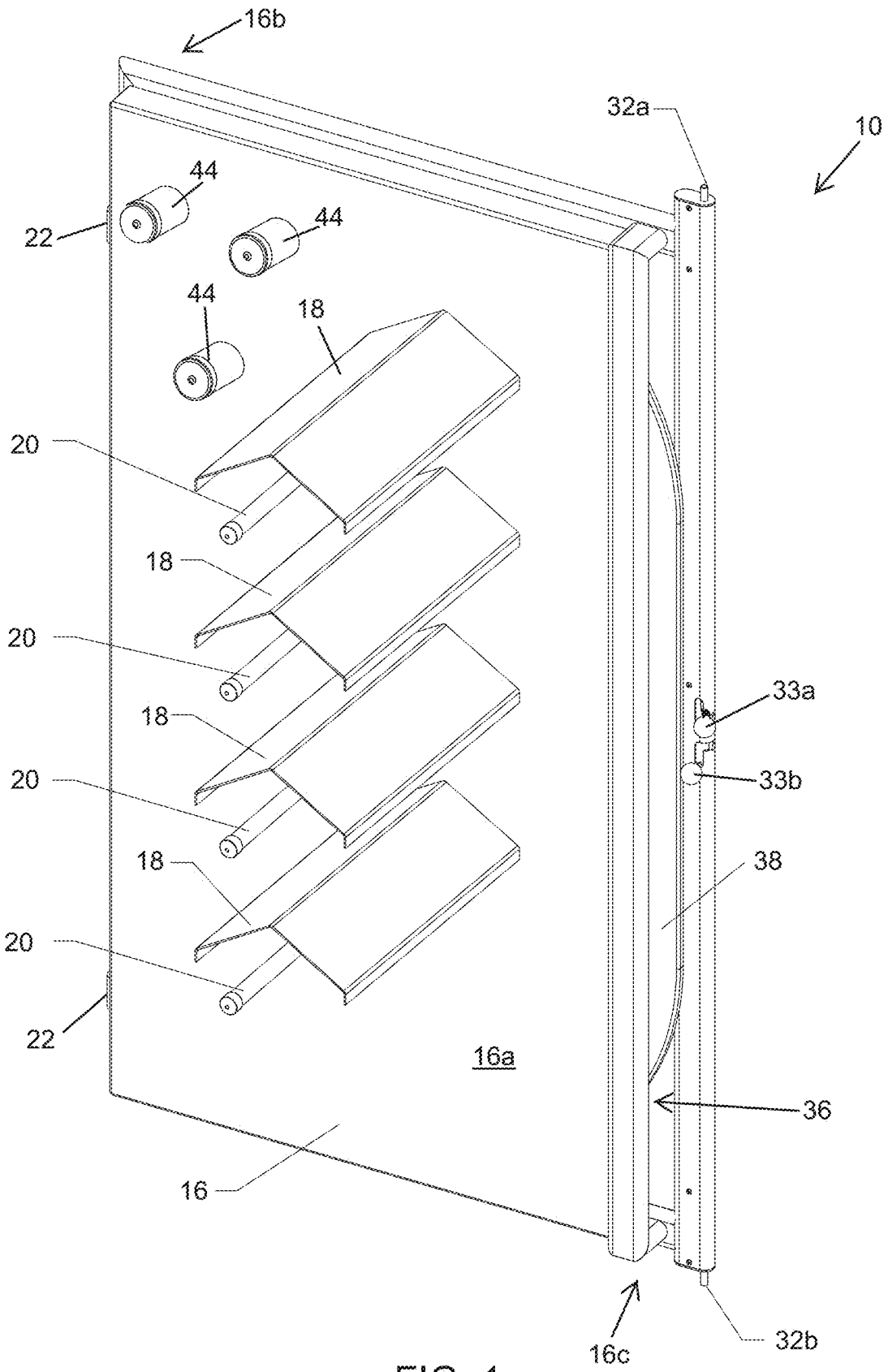
FIG. 1 is a perspective view of a movable storage system in accordance with the present invention.

Referring now to the drawings and the illustrative embodiments depicted therein, a movable storage system or tack wall 10 provides a storage location within a transport trailer 12 for storing various types of equipment such as livestock tack, e.g. saddles 14, blankets 15, leads, headstalls, etc. The storage system 10 may be utilized with various types of transport trailers or vehicles, such as livestock trailers, campers, recreational vehicles, and the like. The storage system 10 may be coupled to the trailer 12 such that it is accessible from an interior or an exterior of the trailer 12. The storage system 10 is particularly well suited for use with horse transport trailers for storage of saddles 14 and other tack while allowing for repositioning of the storage system 10 to provide access to the various portions of the horse trailer and ergonomic access to the load or unload saddles 14 and tack thereon. The storage system 10 is repositionable within the trailer 12 for various activities, including for loading and unloading livestock into the trailer 12, for storing or removing equipment from the storage system 10, and for transport of the trailer 12.

As shown in the illustrated embodiments of FIGS. 1-8, the movable storage system 10 includes a vertical panel 16 defining a moveable wall or door, which is pivotably mountable within the interior of the transport trailer 12. The panel 16 is pivotably coupled to a portion of the interior of the trailer 12 to enable the storage system 10 to be selectively pivoted about a vertical pivot axis. In the illustrated embodiment, the vertical pivot axis is proximate a left side **16*b* of the vertical panel 16 when viewing the panel 16 from the rear of the trailer 12 (FIGS. 1-5 and 7-8). The storage system 10 includes a plurality of storage arms or shelves, including elongated saddle platform arms or racks 18 and elongated bar arms 20 for supporting various types of equipment, such as blankets 15 and leads. The storage arms 18, 20 are fixed to at least one face of the panel 16, such as a rear face 16*a* of the panel 16, such that the storage arms 18, 20 are extend generally horizontal and outward from the vertical panel 16. The storage arms 18, 20 may be inclined and extend from the panel 16 at an upward angle relative to the floor of the trailer to retain equipment and prevent the equipment from accidently sliding off of the storage arms 18, 20. Optionally, the storage arms 18, 20 may be movable vertically relative to the vertical panel 16 to adjust the height of the stored equipment to make loading and unloading at each storage arm 18, 20** easier.

The storage system 10 includes hinges 22 to pivotably couple the panel 16 to a vertical support 24 that is disposed in the trailer 12 (FIGS. 1-5). The vertical pivot axis of the storage system 10 is defined by the pivoting axis of the hinges 22. In the illustrated embodiments, the vertical support 24 defines a portion of a livestock corral or living quarter 26, such as disclosed in commonly assigned U.S. Pat. No. 10,568,297, issued on Feb. 25, 2020, which is incorporated herein by reference in its entirety. The hinges 22 may be barrel hinges or other types of hinges or pivot elements, such as cone and cup bearings. In an alternative embodiment, hinges may be disposed in the ceiling and the floor of the trailer 12, to pivotably support the storage system 10 directly at the ceiling and the floor of the trailer 12.

Figure 2:
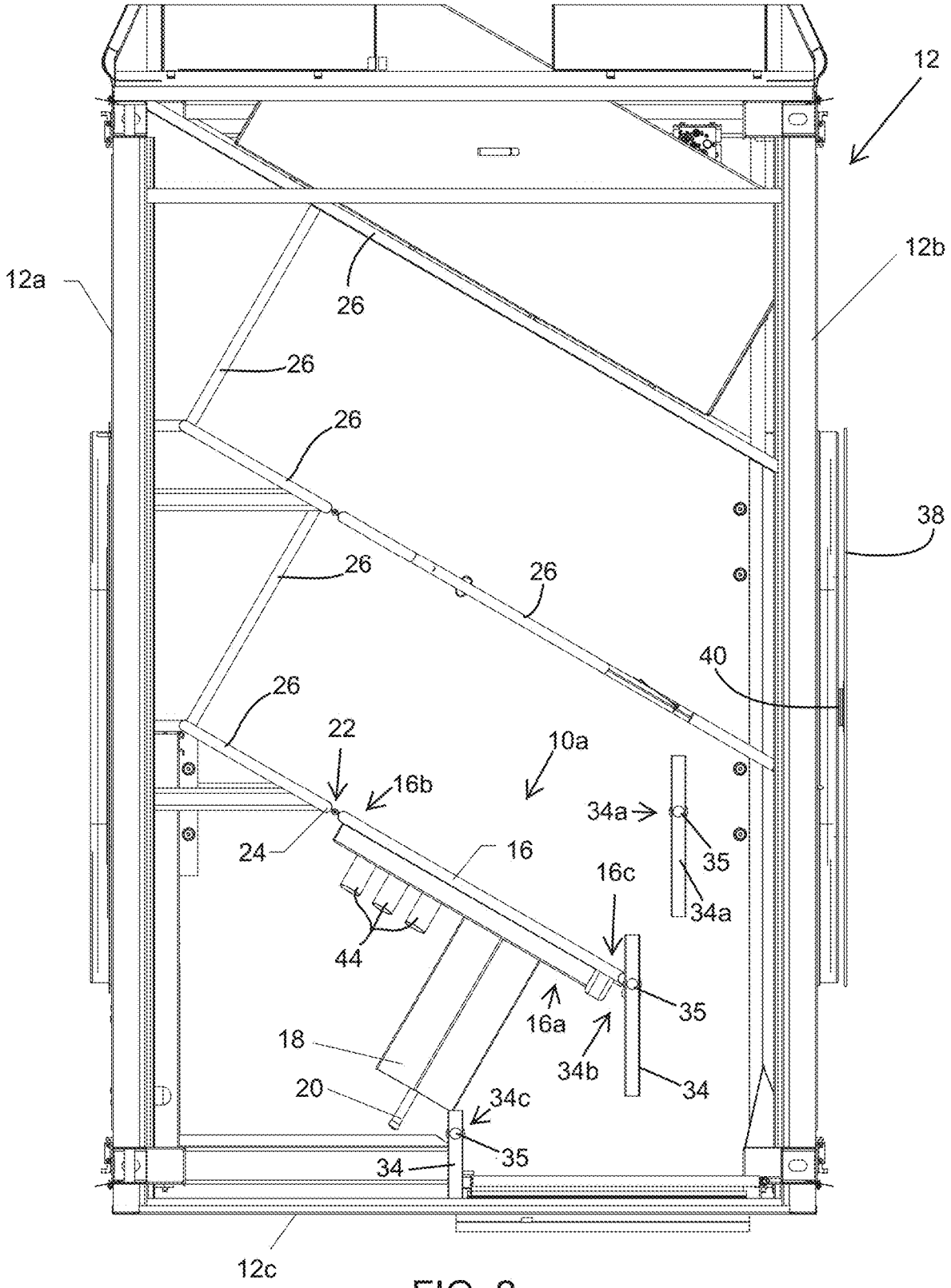
FIG. 2 is a top plan view of the movable storage system of FIG. 1 disposed in a rear portion of a transport trailer, depicting the movable storage system in a transport configuration.

The movable storage system 10 is pivotably repositionable to a plurality of angular positions within the trailer 12 to provide access to storage system 10 and the various portions of the trailer's interior. Angular positions of the system 10 include a transport configuration 10*a* depicted in FIGS. 2 and 7, a tacking configuration 10*b* depicted in FIG. 3, and an access configuration 10*c* depicted in FIGS. 4 and 8. When the storage system is in the transport configuration 10*a*, the vertical panel 16 is at an oblique angle relative to the upright sidewalls 12*a*, 12*b* and rear end 12*c* of the trailer 12 (FIG. 2). In the transport configuration 10*a*, the vertical panel 16 cooperates with the corral 26 and functions as a stall wall to contain and/or support a rear quarter of the animal contained within the corral 26, such as in the event that the animal stumbles or slides backward toward the rear of the trailer 12 (FIG. 2). When the storage system is in the tacking configuration 10*b*, the vertical panel 16 is substantially perpendicular to the sidewalls 12*a*, 12*b* of the trailer and parallel to the rear end 12*c* of the trailer (FIG. 3).

Figure 4:
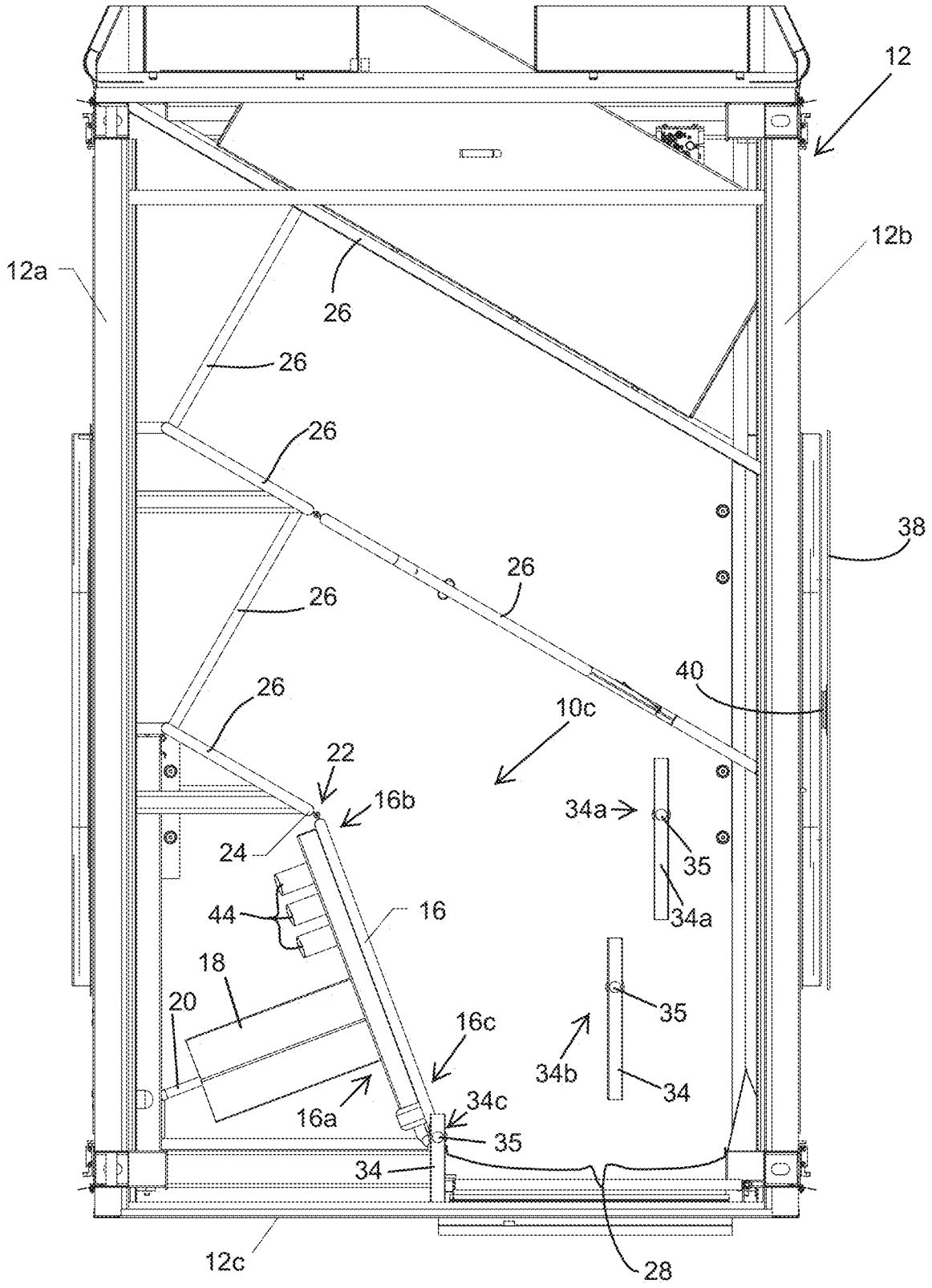
FIG. 4 is another top plan view of the movable storage system of FIG. 2, depicting the movable storage system in a load/unload or access configuration.
Figure 8:
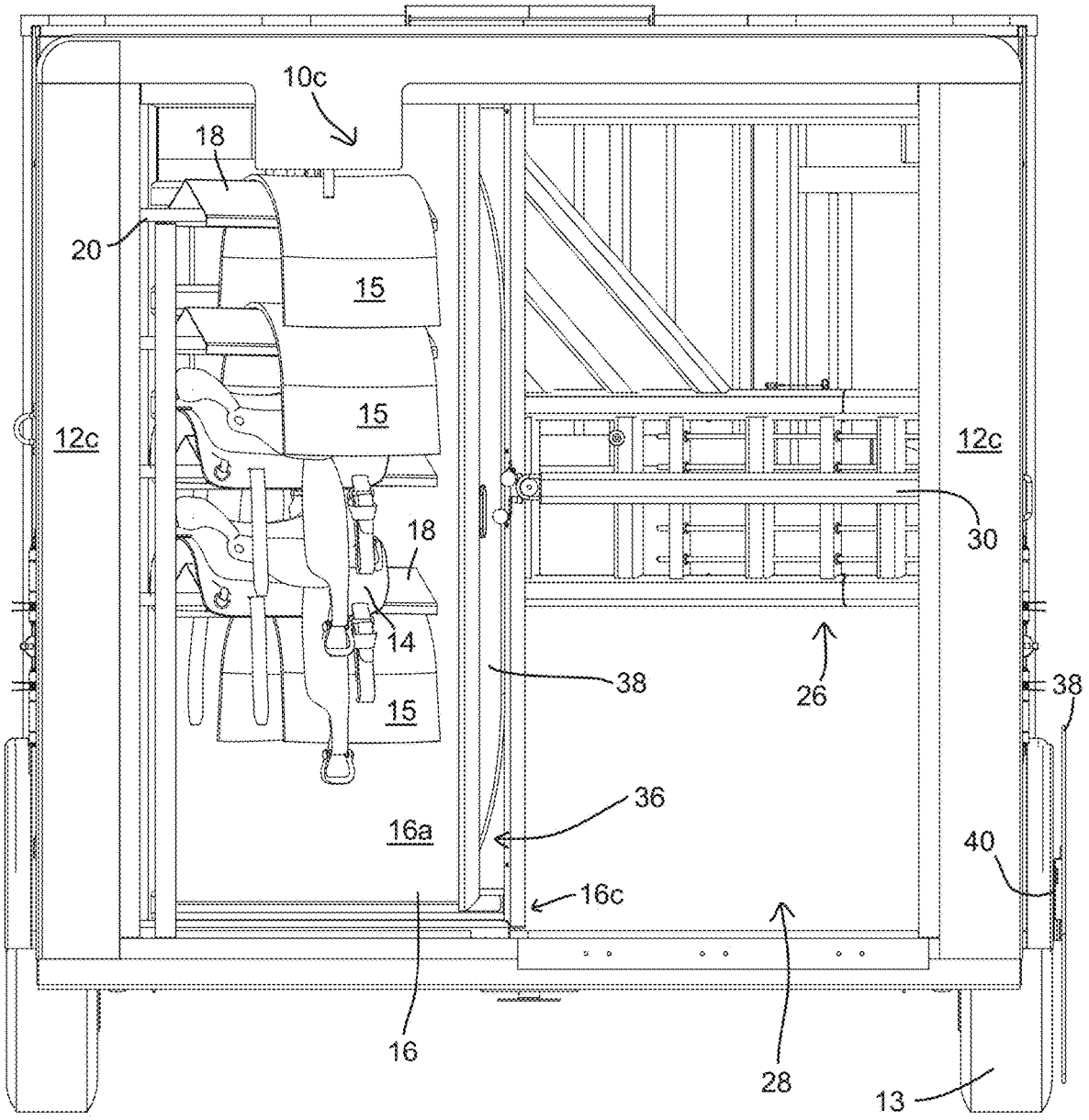
FIG. 8 is another rear perspective view of the movable storage system of FIG. 7, depicting the storage system in the load/unload or access configuration.

In the tacking configuration 10*b*, a user is able to load or unload equipment on to the storage arms 18, 20 while standing inside of the trailer 12. The user is able to ergonomically lift the equipment substantially without straining to reach at an awkward angle or position relative to the storage system 10, providing for safe and efficient loading and unloading of equipment. As shown in FIG. 4, when the storage system is in the access configuration 10*c*, the vertical panel 16 is positioned at an oblique angle, relative to the rear end 12*c*, that is substantially greater than the oblique angle of the panel 16 in the transport configuration 10*b*. In the access configuration 10*c*, an access opening 28 is created between the panel 16 and sidewall 12*b* to allow livestock or users to enter into living quarter 26 or the interior space of the trailer forward of the storage system 10 (FIGS. 4 and 8). A gate or "butt bar" 30 may be provided to form a barrier along the access opening 28 to temporarily pen livestock into the trailer 12 while the storage system 10 is in the access configuration 10*c* (FIG. 8).

Figure 5:
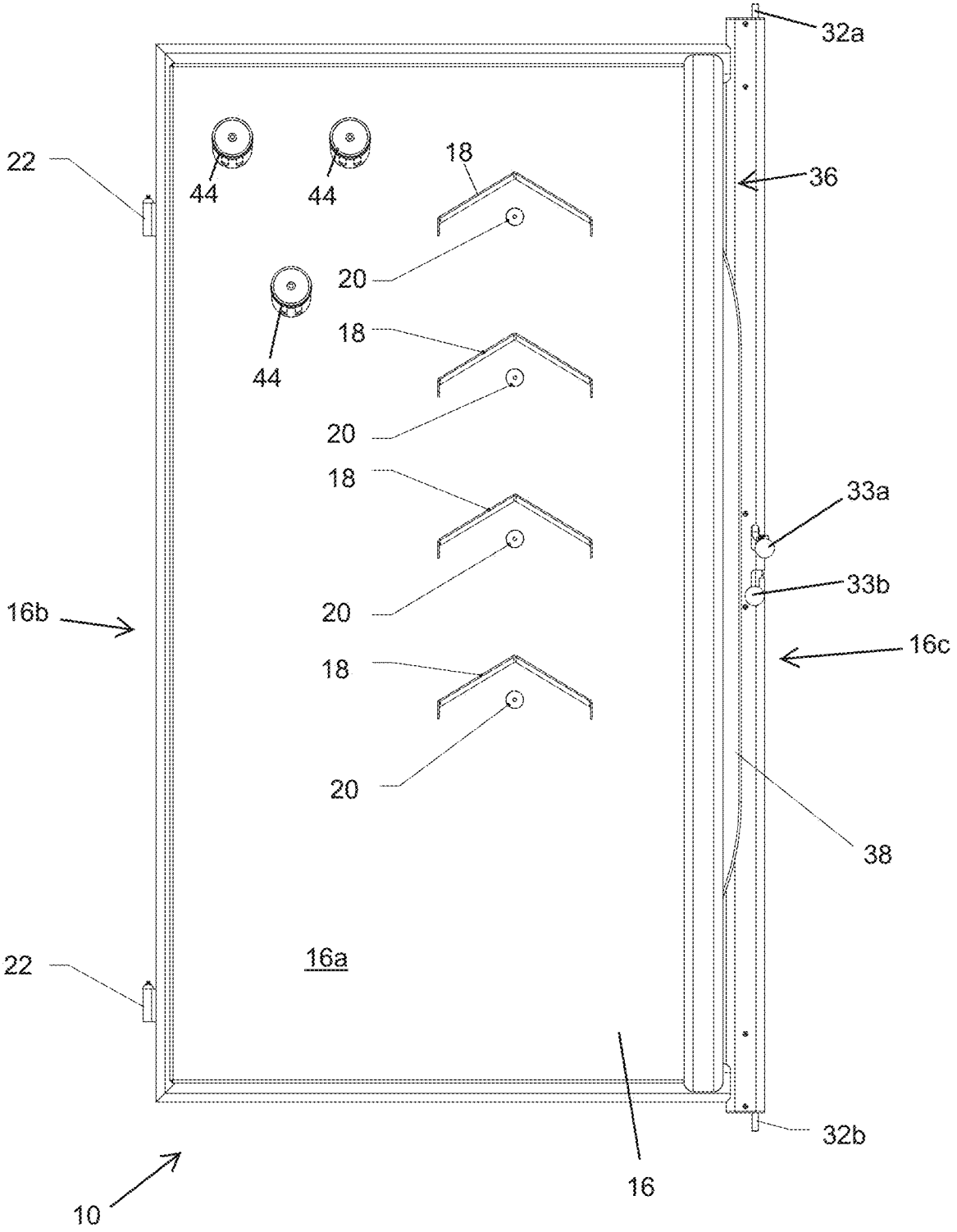
FIG. 5 is a front view of the movable storage system of FIG. 1.
Figure 6:
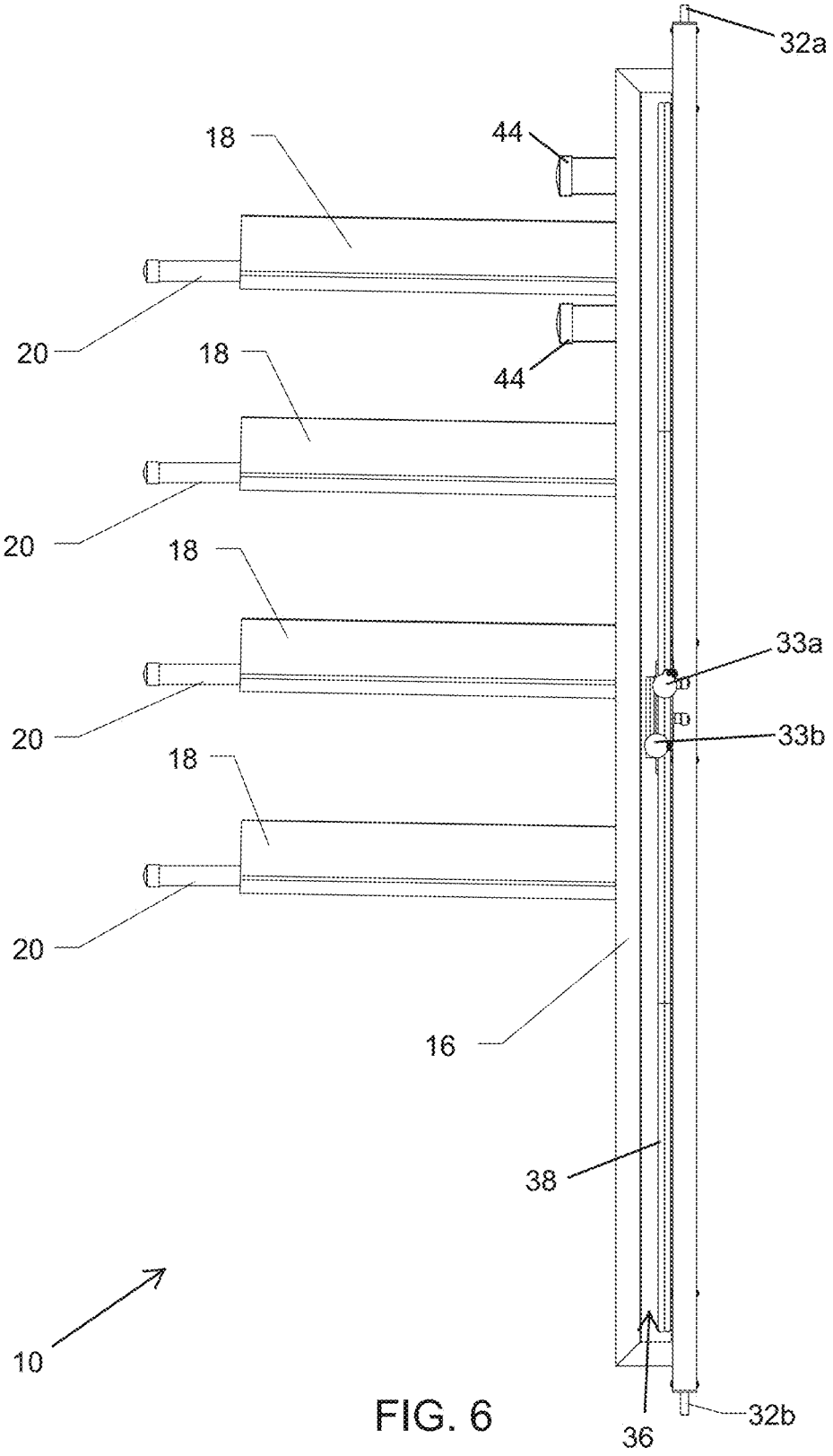
FIG. 6 is a right side view of the movable storage system of FIG. 1.
Figure 7:
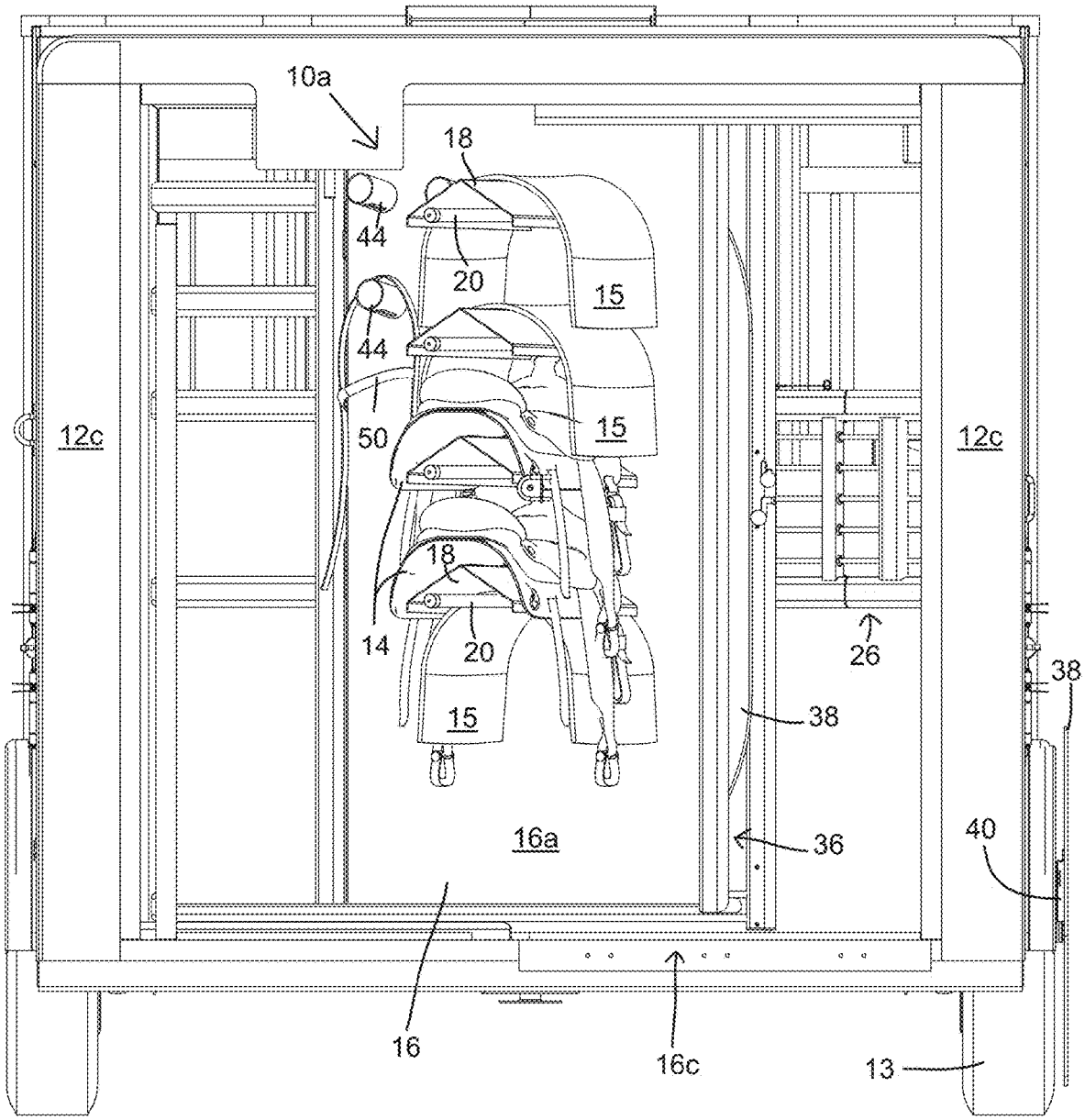
FIG. 7 is a rear perspective view of the movable storage system of FIG. 1 disposed in a transport trailer, depicting the movable storage system in the tacking configuration.

As best illustrated in FIGS. 1 and 5-6, the storage system 10 includes an upper latching pin 32*a* and a lower latching pins 32*b* disposed respectively at upper and lower portions of a right side 16*c* of the vertical panel 16. The latching pins 32*a*, 32*b* may be manually operated and/or spring loaded pins that are spring-biased to extend and engage a portion of the trailer 12 to secure the storage system 10 at one of the plurality of angular positions. The latching pins 32*a*, 32*b* are selectively operable (via handles or knobs 33*a* and 33*b*) to release the storage system 10 for repositioning it to a different configuration. As an example, the upper latching pin 32*a* may be a spring-biased pin and the lower latching pin 32*b* may be a gravity-biased pin. Thus, to operate the latch pins 32*a*, 32*b* when repositioning the storage system 10, a user lifts the handle 33*b* corresponding to the lower latch pin 32*b* (against gravity) and lowers the handle 33*a* corresponding to the upper latch pin 32*a* (against spring force). Once the storage system 10 is in the desired configuration, the user releases the handles 33*a* and 33*b* and the upper latch pin 32*a* raises due to the spring force and the lower latch pin 32*b* falls due to gravity.

Figure 3:
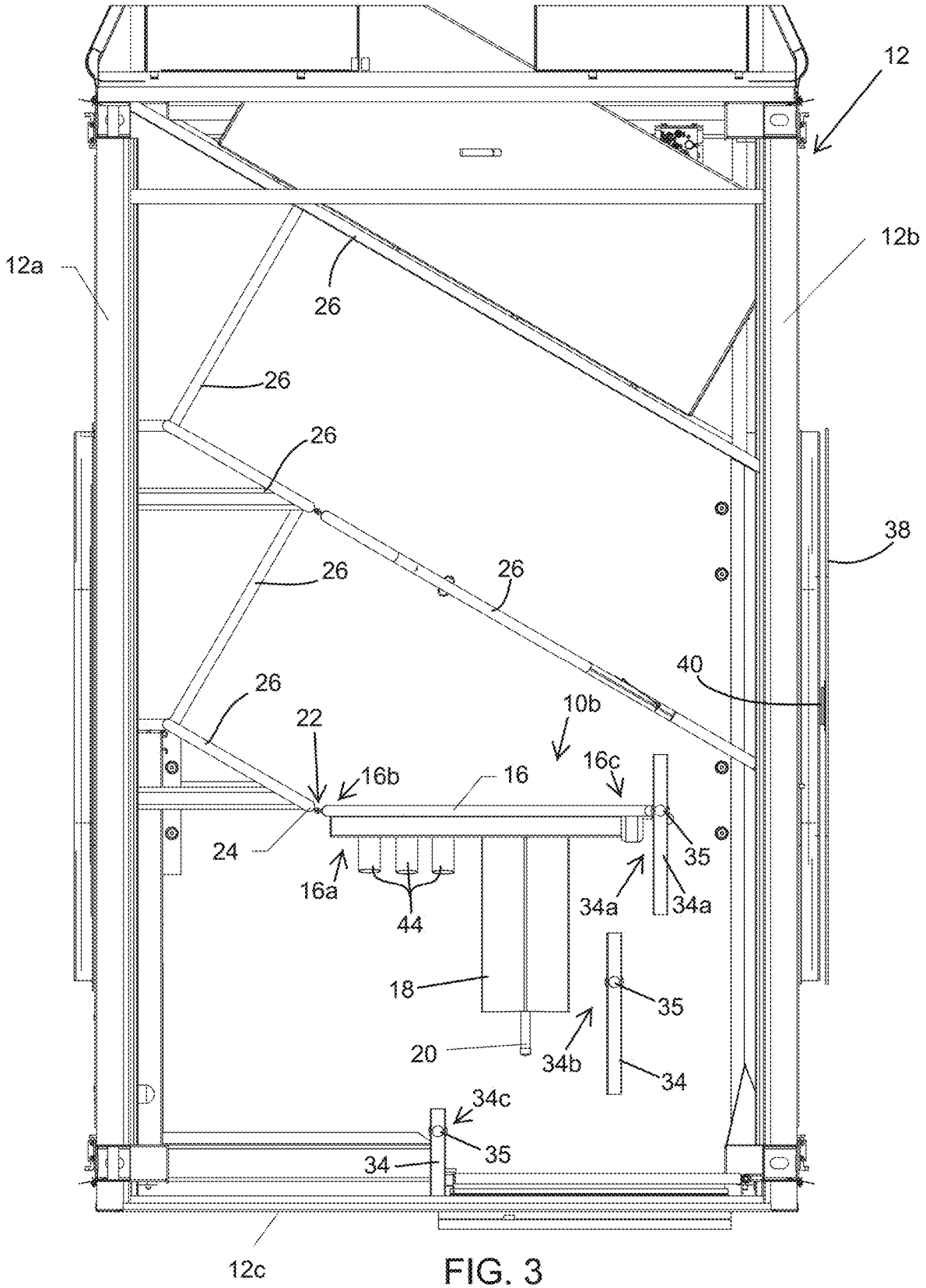
FIG. 3 is another top plan view of the movable storage system of FIG. 2, depicting the movable storage system in a tacking configuration.

As shown in FIGS. 2-4, a plurality of latching points 34*a*, 34*b*, and 34*c* are disposed in spaced arrangement within the trailer 12 to provide receiver locations that receive the latch pins 32*a* and 32*b* when the vertical panel 16 is positioned at an angular position (configuration) corresponding to one of the latching points 34*a*, 34*b*, 34*c*. The locations of the latching points 34*a*, 34*b*, and 34*c* each define a set angular position of the storage system 10. When the latch pins 32*a*, 32*b* engage a forward or transport latching point 34*a*, the storage system 10 is in the tacking configuration 10*b* (FIG. 3). When the latch pins 32 engage a middle or tacking latching point 34*b*, the storage system 10 is in the transport configuration 10*a* (FIG. 2). When the latch pins 32 engage a rearward or access latching point 34*c*, the storage system 10 is in the access configuration 10*c* (FIG. 4). Each latching point 34*a*, 34*b*, and 34*c* includes one latch plate 34 disposed in the floor of the trailer 12 and one latch plate disposed in the ceiling of the trailer 12, such that each corresponding pair of plates are vertically aligned with one another. Each latch plate 34 includes a hole 35 that defines a receiver slot that is sized and shaped to receive the extending end of a respective latch pin 32*a*, 32*b*. It will be appreciated that a single latch pin and single latch plate may be sufficient to secure the storage system 10 at a desired configuration. For example, the upper latch pin 32*a* and the ceiling latch plate(s) may be omitted such that only the lower latch pin 32*b* and latch plate(s) 34 on the floor at latching points 34*a*, 43*b*, and 34*c* are provided to secure the storage system 10 in the transport configuration (FIG. 2), the tacking configuration (FIG. 3), or the access configuration (FIG. 4).

Figure 11:
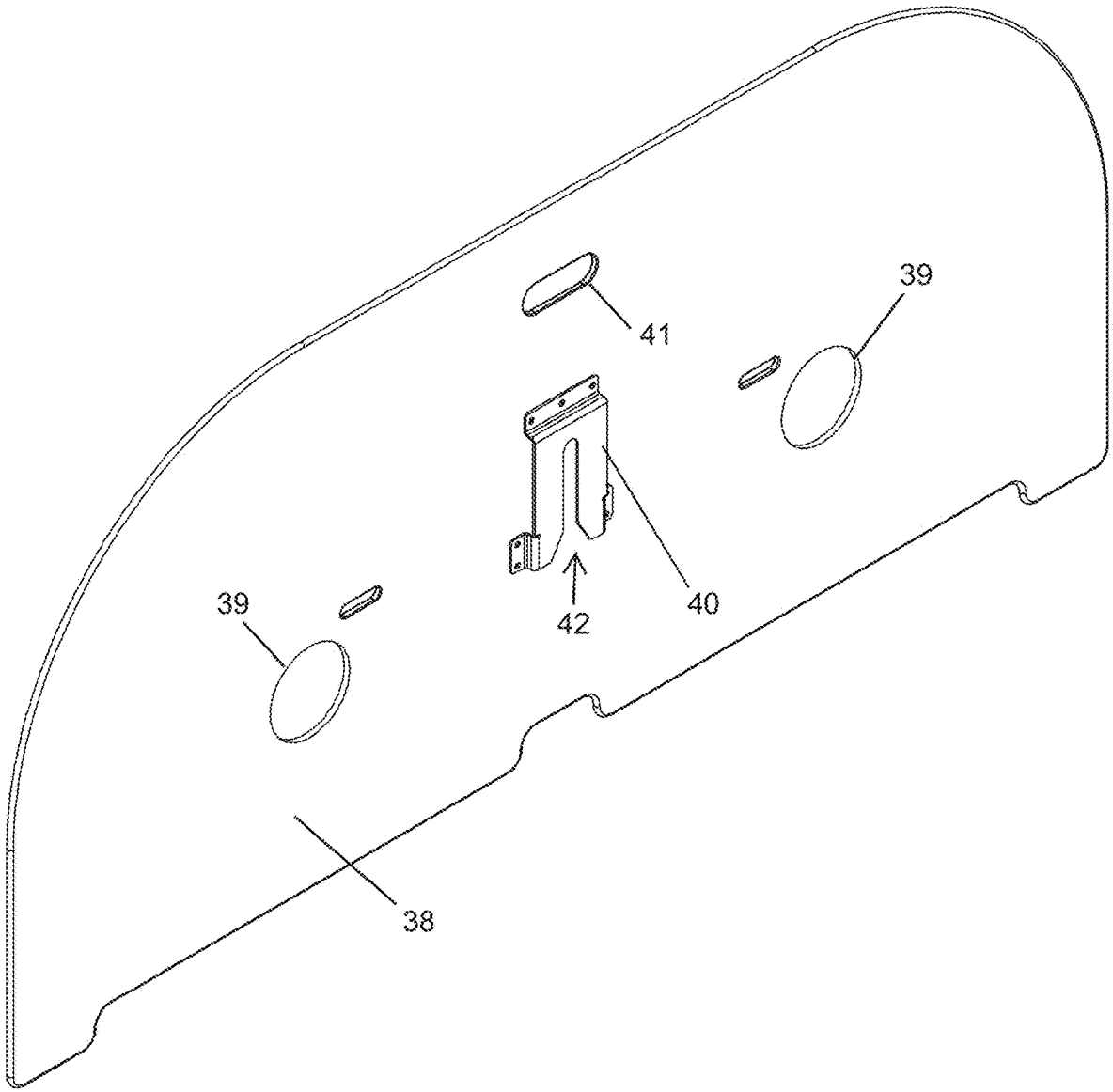
FIG. 11 is a perspective view of a wheel cover sized and shaped to fit within a compartment of the movable storage system of FIG. 1.

The storage system 10 includes a compartment 36 to store large, narrow or flat equipment, such as trailer wheel covers 38 (FIGS. 1 and 5-8). The compartment 36 is defined by a narrow vertical opening proximate the right side 16*c* of the vertical panel 16. The compartment 36 at least partially defines rear face 16*a* of the panel 16 and may extend from the bottom of the panel 16 to the top, and toward the left side 16*b* of the panel. The wheel cover 38 is provided for covering the wheels of the trailer 12 so that livestock animals near the exterior of trailer cannot fidget with the wheels or extends their bodies or limbs under the wheel wells of the trailer (FIGS. 2-4 and 7-8). The wheel cover 38, as best shown in FIG. 11, may be dimensioned and shaped to cover various sizes of wheel well opening sections of the trailer, such as for single, double, or triple axle trailers, for example. The wheel cover may be formed of metal, plastic, wood, or the like, such that it is durable and resilient yet lightweight to allow a single user to carry the wheel cover 38. The wheel cover 38 includes cutouts 39 to receive or fit over wheel hubs of the wheels of the trailer 12 and a handle cutout 41 to provide a grip or handle for a user to transport the wheel cover 38 (FIG. 11).

Referring to FIGS. 2-4, 7-8, and 11, the wheel cover 38 includes a hanger or support bracket 40 for securing the wheel cover alongside an exterior wall of the trailer 12 such that the wheel cover is secured in place adjacent to the wheels 13 (FIGS. 7 and 8) of the trailer 12. In other words, the wheel cover 38 can be secured to the trailer 12 so that an animal or person cannot easily dislodge or displace the wheel cover 38 from its position alongside the wheels 13 of the trailer. The bracket 40 defines a gap forming a channel or track 42 in the bracket body. The channel 42 is dimensioned to receive and engage a bolt, lug, or stud that is fixed to the exterior of the trailer 12 proximate the wheel well of the trailer. The width of the gap forming the channel 42 is slightly larger than the thickness of the main body of the stud and the gap of the channel is smaller than the thickness of a head portion of the stud. The wheel cover 38 is installed by placing the bracket channel 42 over the trailer stud and lowering the wheel cover 38 down so that the channel 42 straddles the body of the stud with the body of the bracket 40 positioned between the head of the stud and the trailer 12. Thus, the bracket channel 42 can receive or straddle the body of the stud when the wheel cover 38 is installed on the trailer 12 and the bracket 40 is secured on the stud by the stud's head. In other words, when the bracket 40 is installed on the stud, the bracket 40 cannot slide off of the stud along the axial direction of the stud. In order to remove the wheel cover 38, it must be lifted upward until the channel 42 has cleared the stud.

Figure 9:
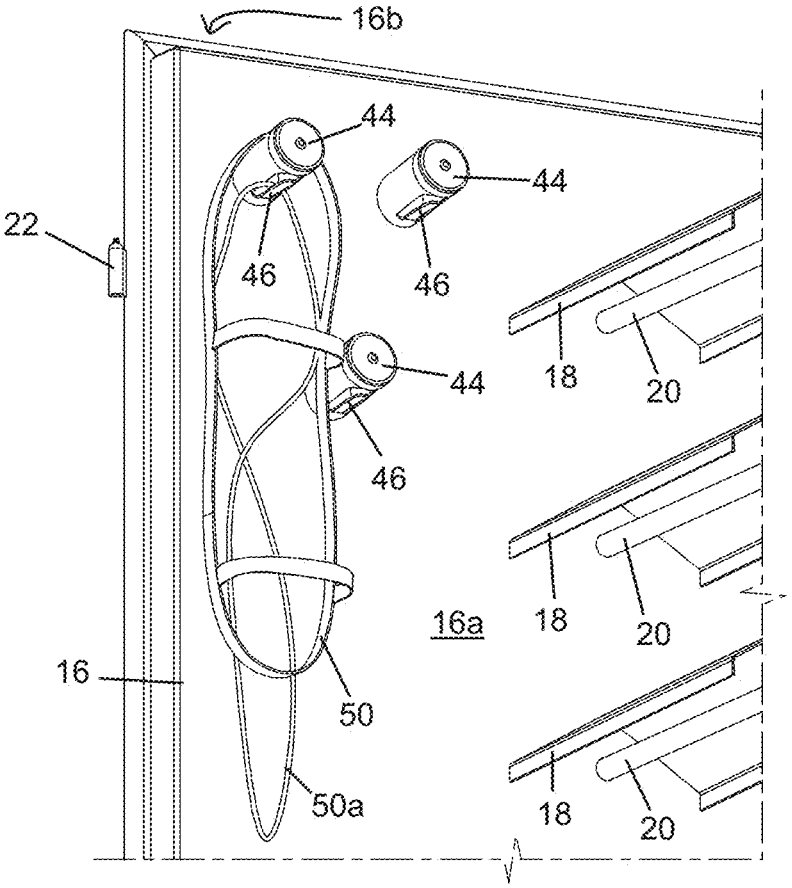
FIG. 9 is an enlarged partial perspective view of a plurality of bridle hangers disposed on the movable storage system of FIG. 1.
Figure 10:
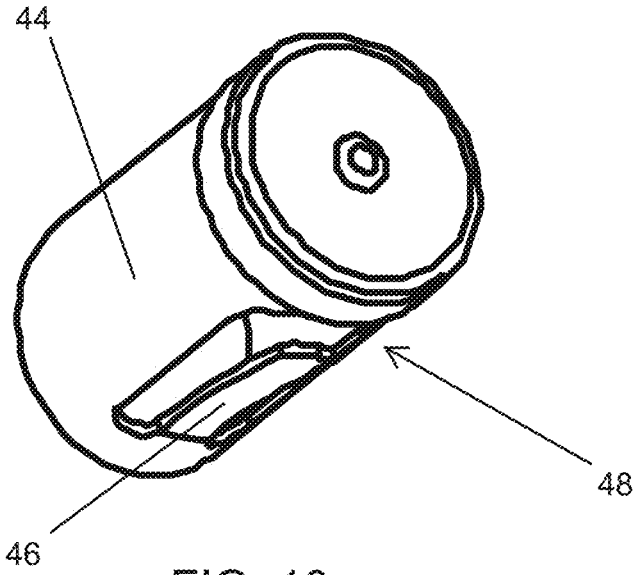
FIG. 10 is an enlarged perspective view of one of the bridle hangers of FIG. 9.

Referring to the illustrative embodiments of FIGS. 9 and 10, bridle or equipment hangers 44 are provided for supporting and organizing equipment, such as livestock bridles or headstalls. Each hanger 44 extends generally horizontal and outward from the vertical panel 16 and may be inclined and extend from the panel 16 at an upward angle relative to the floor of the trailer 12 to retain equipment and prevent the equipment from accidently sliding off of the hanger 44. Each hanger 44 is defined by a round main body and includes an equipment support tab or finger 46. The finger is formed by a portion of the main hanger body that is at the center of a horseshoe or U-shaped cutout 48, as best shown in FIG. 10, in the body of the hanger 44. The finger 46 may be bent or angled away from the main body of the hanger 44 and is provided for supporting an equipment article on a lower side of the hanger 44. For example, long equipment items such as a bridle or headstall 50 for a horse (FIGS. 7 and 9), may be hung over the top of the hanger 44 such extended portions of the equipment (e.g. the reins 50*a* of the headstall 50 (FIG. 9)) hang downward from the hanger 44 and then route back upward and over the finger 46.

Embodiments of the movable storage system may support and store at least four saddles and a various additional tack and equipment including saddle blankets, head stalls, leads, etc. The storage system can be positioned or re-positioned in multiple positions or configurations to serve different functions, including a "load/unload" or access configuration to load or unload livestock, a transport configuration that creates a support for the rear quarter of a horse while the trailer is being transported, and a tacking or "tacking up" configuration in which a user can stand next to a saddle and slide it off the storage system more easily than if standing on the ground and reaching into the trailer to retrieve the saddle. The storage system may include latch elements to secure the movable storage system at desired angular positions. The storage system may also include storage compartments for storage of large and narrow equipment. The storage system may coordinate with the trailer to form a barrier or wall to form a pen or corral for an animal. It will be appreciated that although the illustrated embodiment of the storage system is disposed in a transport trailer, it may also be adapted for use in recreational vehicles, such as a camper, as well as in stationary structures, such as a barn.

Changes and modifications in the specifically described embodiments can be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. A moveable tack wall for a transport trailer, said moveable tack wall comprising:

a pivotable upright wall coupled to an interior of the trailer and extending upward from a floor of the trailer, said pivotable wall is moveable between a plurality of angular positions relative to stationary upright walls of the trailer;

a plurality of saddle racks extending from a face of said pivotable wall;

a plurality of equipment support bars extending from said face of said pivotable wall;

a latch pin coupled to a portion of said pivotable wall and spaced apart from a pivot axis of said pivotable wall; and a plurality of pin receivers disposed in spaced arrangement along a surface within the interior of the trailer, the positions of said plurality of pin receivers within the interior of the trailer define said plurality of angular positions for said pivotable wall and each of said plurality of pin receivers provides a latching point for said pivotable wall;

wherein said latch pin is configured to selectively engage one of said plurality of pin receivers.

2. The moveable tack wall of claim 1, further comprising an upper pivot element and a lower pivot element disposed on one side of said pivotable wall and respectively coupled to the floor and a ceiling of the trailer, said upper pivot element and said lower pivot element defining a vertical pivot axis of said pivotable wall.

3. The movable tack wall of claim 1, further comprising a plurality of hinges coupling a side of said pivotable wall to a vertical support of a livestock corral at the interior of the trailer, said vertical support disposed vertically between a ceiling and the floor of the trailer.

4. The movable tack wall of claim 1, further comprising a removable gate configured to form a barrier along an opening defined between said pivotable wall and a stationary upright wall of the trailer.

5. The moveable tack wall of claim 1, further comprising a handle coupled to said latch pin and operable to move said latch pin to engage or release said latch pin at one of said pin receivers.

6. The moveable tack wall of claim 1, wherein each of said plurality of pin receivers comprises a latch plate disposed at at least one of the floor of the trailer and a ceiling of the trailer, said latch plates each comprising a receiver slot to receive a portion of said latch pin.

7. A transport trailer comprising said moveable tack wall of claim 1.

8. A moveable tack wall for a transport trailer, said moveable tack wall comprising:

an upright panel pivotably mounted at an interior of the trailer and pivotable about a vertical pivot axis proximate one side of said upright panel to selectively position said upright panel at one of a plurality of angular positions;

a plurality of storage arms extending from a face of said upright panel and configured for storing equipment;

a latch pin coupled to said upright panel and spaced apart from said vertical pivot axis;

a plurality of pin receivers positioned in a spaced arrangement along at least one chosen from a floor and a ceiling of the trailer adjacent to said upright panel, wherein the positions of said plurality of pin receivers define said plurality of angular positions for said upright panel and each of said plurality pin receivers providing a latching point for said upright panel; and a handle coupled to said latch pin and operable to move said latch pin to selectively engage or release said latch pin at one of said plurality of pin receivers.

9. The moveable tack wall of claim 8, wherein each of said plurality of pin receivers comprises a latch plate comprising a receiver slot configured to receive a portion of said latch pin.

10. The moveable tack wall of claim 8, further comprising an equipment hanger bracket coupled to said upright panel, said equipment hanger bracket comprising a hollow, elongate main hanger body and an equipment support finger coupled to a portion of said main hanger body.

11. The moveable tack wall of claim 10, wherein said main hanger body defines a U-shaped cutout, wherein said equipment support finger is formed by a portion of said main hanger body in the center of said U-shaped cutout.

12. The moveable tack wall of claim 8, further comprising an upper pivot and a lower pivot disposed on one side of said upright panel and each coupled to a portion of the trailer, said upper and lower pivots defining said vertical pivot axis.

13. The moveable tack wall of claim 12, wherein said upper and lower pivots comprise barrel hinges disposed between said side of said upright panel and a vertical support that is disposed vertically at an interior of the trailer.

14. The moveable tack wall of claim 12, wherein said upper and lower pivots comprise cup and cone bearings disposed between said side of said upright panel and respective ones of a floor and a ceiling of the trailer.

15. The moveable tack wall of claim 8, wherein said plurality of storage arms comprise at least one of a saddle platform for supporting a saddle and an elongate bar for supporting livestock tack.

16. The moveable tack wall of claim 8, further comprising a removable gate configured to form a barrier along an opening defined between said upright panel and a stationary upright wall of the trailer.

17. The moveable tack wall of claim 8, further in combination with the transport trailer.

18. The moveable tack wall and transport trailer of claim 17, further comprising a removable wheel cover for covering a wheel section at the exterior of said trailer while said trailer is not in transport, and wherein said upright panel defines a portion of a compartment configured to receive said wheel cover.

19. The moveable tack wall and transport trailer of claim 18, wherein said wheel cover comprises a support bracket for coupling said wheel cover to the exterior of said trailer.

20. The movable tack wall and transport trailer of claim 7, further comprising a removable wheel cover for covering a wheel section at the exterior of said trailer while said trailer is not in transport, and said pivotable wall defining a portion of a compartment that defines a storage space and is configured to receive and secure said wheel cover, said wheel cover comprising a support bracket for coupling said wheel cover to the exterior of said trailer.

* * * * *